US008585518B2

(12) United States Patent
Dai

(10) Patent No.: US 8,585,518 B2
(45) Date of Patent: Nov. 19, 2013

(54) SHUTTLECOCK

(76) Inventor: Jianlin Dai, Changshu Hunan (CN)

( * ) Notice: Subject to any disclaimer, the term of this patent is extended or adjusted under 35 U.S.C. 154(b) by 0 days.

(21) Appl. No.: 13/261,185

(22) PCT Filed: Oct. 26, 2009

(86) PCT No.: PCT/CN2009/001189
§ 371 (c)(1),
(2), (4) Date: Feb. 16, 2012

(87) PCT Pub. No.: WO2011/020224
PCT Pub. Date: Feb. 24, 2011

(65) Prior Publication Data

US 2012/0157248 A1 Jun. 21, 2012

(30) Foreign Application Priority Data

Aug. 21, 2009 (CN) ..... 2009 1 0044168

(51) Int. Cl.
*A63B 67/18* (2006.01)

(52) U.S. Cl.
USPC ..... 473/580

(58) Field of Classification Search
USPC ..... 473/579, 580
See application file for complete search history.

(56) References Cited

U.S. PATENT DOCUMENTS

| | | | | | |
|---|---|---|---|---|---|
| 2,666,643 | A | * | 1/1954 | William | 473/580 |
| 3,752,479 | A | * | 8/1973 | Chung | 473/580 |
| 4,657,262 | A | * | 4/1987 | Buckland | 473/580 |
| 5,421,587 | A | * | 6/1995 | Mao-Huang | 473/579 |
| 5,562,290 | A | * | 10/1996 | Wei | 473/570 |

* cited by examiner

*Primary Examiner* — John Ricci
(74) *Attorney, Agent, or Firm* — Raymond Y. Chan; David and Raymond Patent Firm

(57) ABSTRACT

A shuttlecock includes a ball head, a pinnae supporter and some pinnae. The pinnae supporter and the ball head can be made integrally or connected after being made respectively. The pinnae are inserted into the tubes of the pinnae supporter.

9 Claims, 3 Drawing Sheets

SHUTTLECOCK

BACKGROUND OF THE PRESENT INVENTION

1. Field of Invention

The present invention relates to a sporting article, and more particularly to a shuttlecock.

2. Description of Related Arts

Conventional shuttlecock involves hand-made manufacturing process in which natural feather is planted onto a cock, a bottom portion is coated with glue which is then heated and dried, and a stem of the feather is twined with double threads, applied with a layer of glue and secured in position after heating and drying. The drawbacks for this kind of conventional shuttlecock are as follows:

First, the entire process requires about 20 days and a number of steps that is time consuming and labor intensive. Thus, the cost of labor is high.

Second, the natural feather has great variation in shape. The weight, the angle of the tapered end of the shaft, and the thickness of each particular feature are different from each other, so that their centers of mass cannot be made overlappedly and concentrically. Therefore, it is very difficult to make a shuttlecock that has a curvature complementary to its thickness.

Third, the process of manufacture of the conventional shuttlecock, which is a hand-made process, is hard to be standardized under a strict and universal standard in which the gap between two tapered ends of any two particular feathers is not standardized and the thread level is not strictly parallel. The shuttlecock as produced has low consistence and the quality cannot be controlled that the technical functionality of the shuttlecock is adversely affected.

SUMMARY OF THE PRESENT INVENTION

Accordingly, the present invention provides solutions to the following problems. In order to solve the above technical problems, the present invention provides a shuttlecock through a manufacturing process which is a mechanized, automatic, standardized, controllable, and industrialized process of manufacture, such that the weight and thickness of the stem of each particular feather and the tapered end of the shaft of each particular feather are standardized, while the level of roundness is high and the center of mass is overlapped and concentric at a central axis of the shuttlecock, thereby the specification of the shuttlecock is accurately followed, the technical performance of the shuttlecock is high and the quality is superior.

Additional advantages and features of the invention will become apparent from the description which follows, and may be realized by means of the instrumentalities and combinations particular point out in the appended claims.

According to the present invention, the foregoing and other objects and advantages are attained by a shuttlecock which comprises a cock unit, a feather support and a feather unit connecting together. In which, the cock unit and the feather support can be integrally formed in one step. Or, the cock unit and the feather support are connected together after the cock unit and the feather support are made in separate steps, and then the feather unit is inserted into the feather support.

According to the above embodiment, the feather support is made by molding and comprises a plurality of feather connecting members and a plurality of skirt reinforcing members.

According to the above embodiment, the feather unit is made of natural goose feather, primaries of duck wings or synthetic materials, wherein the feather unit has an upper portion defining a feather member and a bottom portion defining a shaft member.

According to the above embodiment, the feather connecting member of the feather support of each particular feather unit is injected with equal amount of glue or is molded to have a fish bone construction. The shaft member of the bottom portion of the feather unit is inserted to the feather connecting member of the feather support and is secured into position by the adhesive glue or the fish bone structure.

According to the above embodiment, the cock unit can be a traditional cock or a cock having a detachable cap, thereby a weight or a grading of the shuttlecock can be adjusted to providing different choices to people. Accordingly, the shuttlecock is suitable for use in indoor facilities and outdoor sports venues while the cock unit is protected and its elasticity is maintained.

According to the above embodiment, the feather unit is made in tailored natural feather or synthetic materials in which a stem portion of the feature unit is internally, externally or internally and externally coated with reinforcing materials, wherein the reinforcing materials for coating the stem portion internally is macromolecule polymer and the reinforcing materials for coating the stem portion externally is reinforcing glue, thereby the rigidity of the feather unit is increased and the problem of breaking during the hitting impact of shuttlecock is solved.

Compared to the conventional technology, the present invention has the following characteristics and improvements:

1. Structure: Conventional shuttlecock consists of a feather unit and a cock only, while the present invention includes a cock unit, a feather unit and a feather support.

2. Major materials: Conventional shuttlecock's feather is made from the bigger piece of natural goose and duck wings that must has a length of 75-78 mm, and thus each particular bigger feather can only be pressed to produce one feather member for the feather unit and all feathers of one goose can only produce 0.8 unit of shuttlecock. However, the present invention can utilize feather from both natural goose and duck wings that has a length of about 39-45 mm, and that each particular feather can be made to produce two feather members for the feather unit. The feather of the present invention can also be made of synthetic materials.

3. Manufacturing process: For the conventional shuttlecock, the process includes: tailoring feather, planting the feather onto a cock, adjusting a height, an angle, and a position of the feather, injecting glue, heating and drying, providing a double-threaded lining to a stem of the feather, tying, adjusting a position of the coil, applying glue to the thread of the lining, heating and drying, maintaining a structure and position, conducting inspection, and packaging. It is really complicated.

According to the present invention, the manufacturing process merely includes: tailoring feather or manufacturing artificial feather, inserting the feather into a molded feather support, positioning the feather support into a cock unit, setting in position for 3 minutes, and packaging. The process is simple and reliable.

4. Time efficiency: The manufacturing process for conventional shuttlecock requires 20 days while the manufacturing process of the shuttlecock of the present invention requires not more than 30 minutes.

5. Labor effectiveness: Based on the worldwide production of shuttlecock in a quantity of 4 billion, the conventional manufacturing process requires five hundred thousand workers while the manufacturing process of the present invention is mechanized and automatic that requires only nine thousand workers.

6. Manufacturing process and standard: Conventional shuttlecock is mainly hand-made, that is really labor intensive, and supplemented with machineries. Therefore, it is difficult to achieve a strict specification with standardized and specific requirements, and the scale of production is small, the place of production is not centralized, and the management difficulty is high. The manufacturing process of the shuttlecock of the present invention is mechanized, automated, standardized, and industrialized.

7. Quality control:

(1) Consistency: For the conventional shuttlecock, each particular feather of natural feather is different from each other, the centers of their mass are not overlapped and concentric, and their thickness, which is the ratio of the thinnest end to the thickest end, are different. For the present invention, each particular set of feather has a predetermined weight, their centers of mass can be overlapped and concentric at a central axis of the shuttlecock, and the thickness of each particular feather can be made correspondingly the same due to the shortened length thereof.

(2) Roundness: The tapered end of each particular feather of a conventional shuttlecock has greater variation in roundness, while the tapered end of each particular feather of the shuttlecock of the present invention has low variation in roundness.

(3) Diameter of shuttlecock—distance of two tapered ends of two feathers at directly opposite position: Conventional shuttlecock cannot guarantee a unique diameter and the greatest standard deviation is about 1.5 mm. The standard deviation of the diameter of the shuttlecock of the present invention can be controlled within a value of 0.5 mm.

(4) Shuttlecock weight control: If the production requirement for a weight of a conventional shuttlecock is about 5.0 g, the actual weight is about 4.7-5.3 g. If the production requirement for a weight of a shuttlecock of the present invention is about 5.0 g, the actual weight thereof is about 4.95-5.05 g. That is the deviation is very low.

(5) Shuttlecock stability: It is very difficult to control a quality of a conventional shuttlecock and the inspection involves manual testing and determination. According to the present invention, the shuttlecock is produced by industrial process of high stability and the step of inspection can be skipped.

(6) Flying speed and point of falling: For conventional shuttlecock, the flying speed and point of falling cannot be determined without manual or mechanized testing. According to the present invention, the flying speed and point of falling for each lot are the same and the step of testing can be skipped.

Accordingly, the manufacturing process of the shuttlecock of the present invention is a simple, reliable, mechanized, automated, standardized and industrialized process that ensures the shuttlecock to meet a standard production requirements in relative to weight, thickness, angle of tapered end and roundness, while the center of mass of the shuttlecock can be made overlapped and concentric at a central axis of the shuttlecock and the flying speed and point of falling can be standardized. In other words, the specification of the shuttlecock is accurate which greatly increase the product quality and technical performance of the shuttlecock.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

Figure 1:
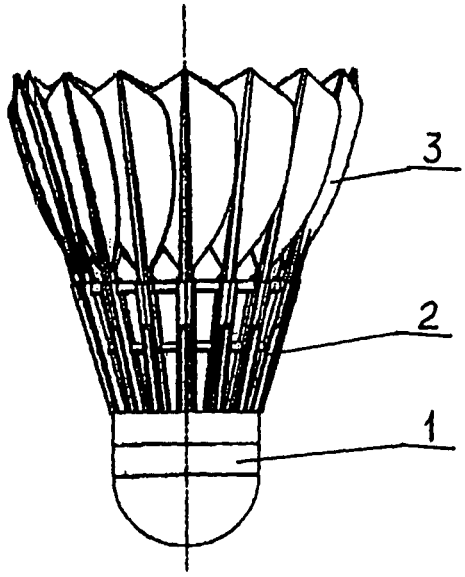
FIG. 1 illustrates a shuttlecock according to a preferred embodiment of the present invention.
Figure 2:
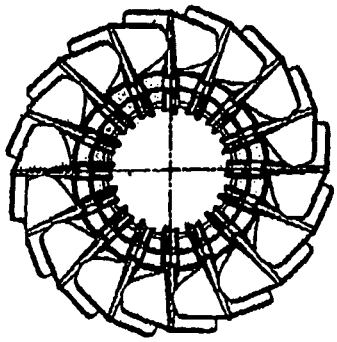
FIG. 2 is a top view of the shuttlecock according to the above preferred embodiment of the present invention.
Figure 3:
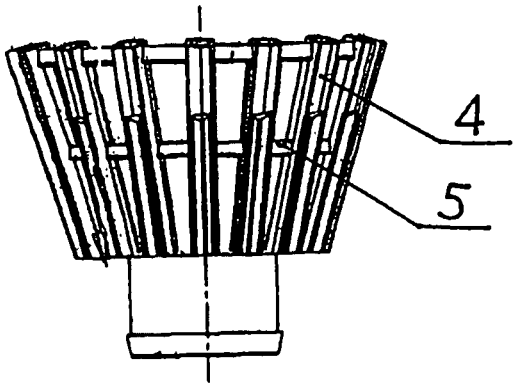
FIG. 3 illustrates a feather support of the shuttlecock according to the above preferred embodiment of the present invention.
Figure 4:
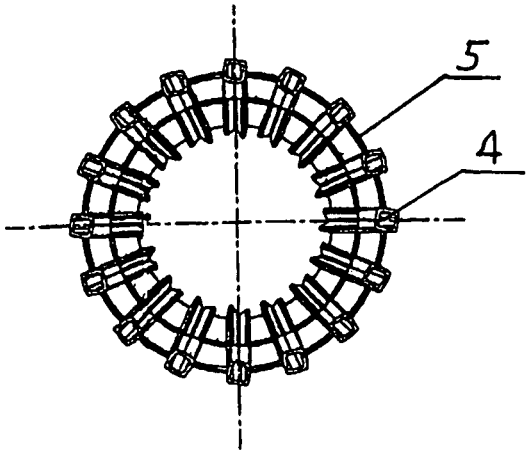
FIG. 4 is a top view of FIG. 3.
Figure 5:
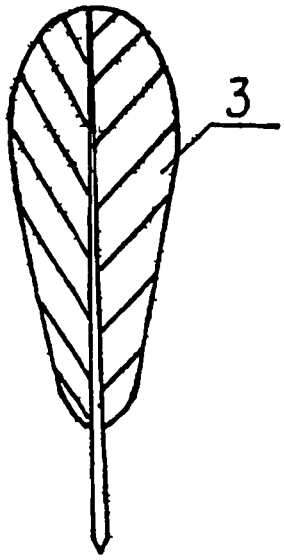
FIG. 5 illustrates a feather of the shuttlecock according to the above preferred embodiment of the present invention.
Figure 6:
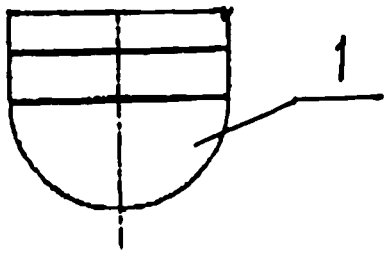
FIG. 6 illustrates a cock unit of the shuttlecock according to the above preferred embodiment of the present invention.

Referring to the drawings, a shuttlecock according to a preferred embodiment of the present invention includes a cock unit 1, a feather support 2 and a feather unit 3 connecting together, wherein the cock unit 1 and the feather support 2 can be integrally made and formed in one single step, or the cock unit and the feather support can be made independently in separate steps respectively and then connected together. Then, the feather unit 3 is inserted into the feather support 2. The feather support 2, which is made by molding, comprises a plurality of feather connecting members 4 and a plurality of skirt reinforcing members 5.

The feather unit 3 is made of natural goose feather, primaries of duck wings or synthetic materials, wherein the feather unit 3 has an upper portion defining a feather member and a bottom portion defining a shaft member.

The shaft member of the bottom portion of the feather unit 3 is inserted to the feather connecting member of the feather support and is secured in position by bonding or a fish bone structure.

The cock unit may further include a detachable cap provided thereon, which protects the cock unit, maintains the elasticity and allows weight and grading adjustment, thereby providing choices to people to fit its application under different environmental and weather conditions.

In addition, a stem portion of the feather unit can be coated with reinforcing materials internally, externally or both internally and externally. The reinforcing materials for coating the stem portion internally is macromolecular polymer and the reinforcing materials for coating the stem portion externally is reinforcing glue, thereby breaking is prevented when the shuttlecock is being hit and impacted so as to increase the life span and durability of the shuttlecock.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A shuttlecock, comprising: a cock unit, a feather support and a feather unit connecting together, wherein said cock unit and said feather support are able to be either made and formed integrally in one step or made independently in separate steps and then connected together, wherein said feather unit is inserted into said feather support, wherein said feather unit is made of feathers selected from a group selected from natural goose feathers, primaries of duck wings and synthetic materials, wherein said feather unit has an upper portion defining a feather member, a bottom portion defining a shaft member and a stem portion which is internally, externally or internally and externally coated with reinforcing materials, wherein said reinforcing materials for coating said stem portion internally is macromolecular polymer and said reinforcing materials for coating said stem portion externally is reinforcing glue.

2. A shuttlecock, comprising:

a feather support;

a cock unit provided at a first of said feather support; and a plurality of feather units provided at a second end of said cock unit, wherein each of said feather units has an upper portion defining a feather member and a bottom portion defining a shaft member having a length of not more than one third of a length of said feather unit.

3. The shuttlecock, as recited in claim 2, wherein said feather support comprises a plurality of feather connecting members, wherein said shaft members of said feather units are securely connected to said feather connecting members respectively.

4. The shuttlecock, as recited claim 3, wherein each of said feather connecting members has a tubular end and each of said shaft members of said feather units has a tapered end adapted to be inserted into said tubular end of said respective feather connecting member.

5. The shuttlecock, as recited in claim 2, wherein each of said feather units ace is made from a natural feather just having a length of 39-45 mm.

6. The shuttlecock, as recited in claim 2, wherein a standard deviation of a diameter of said shuttlecock is controlled within a value of 0.5 mm.

7. The shuttlecock, as recited in claim 2, wherein a weight of said shuttlecock is 4.95-5.05 g.

8. A method of manufacturing shuttlecock, consisting the steps of:

(a) tailoring a plurality of feather units each having an upper portion defining a feather member and a bottom portion defining a shaft member with a length not more than one third of a length of said feather unit;

(b) inserting said shaft members of said feather units into a plurality of feather connecting members of a feather support which is integrally made by molding; and (c) positioning said feather support into a cock unit to form a shuttlecock.

9. The method, as recited in claim 8, after the step (c), further consisting of a step of setting said shuttlecock in position for not more than 3 minutes.

* * * * *